US005252792A

United States Patent [19]

Joyce

[11] Patent Number: 5,252,792

[45] Date of Patent: Oct. 12, 1993

[54] SUBASSEMBLY FOR A PRESSURE SWITCH

[75] Inventor: Ronald S. Joyce, Palatine, Ill.

[73] Assignee: Eaton Corporation, Cleveland, Ohio

[21] Appl. No.: 758,520

[22] Filed: Sep. 6, 1991

Related U.S. Application Data

[60] Continuation of Ser. No. 561,414, Aug. 1, 1990, abandoned, which is a division of Ser. No. 350,883, May 12, 1989, Pat. No. 4,990,728.

[51] Int. Cl.[5] ..... H01H 35/34

[52] U.S. Cl. ..... 200/83 P; 200/416; 200/574; 200/83 S

[58] Field of Search ..... 307/118; 73/717, 723; 340/626; 200/250, 251, 286, 302.1, 83 R, 83 P, 83 S, 83 SA, 83 WM, 402, 416, 445, 450, 542, 573, 574; 337/319, 320

[56] References Cited

U.S. PATENT DOCUMENTS

| | | | |
|---|---|---|---|
| 3,773,991 | 11/1973 | Krieger et al. | 200/83 P |
| 4,104,495 | 8/1978 | Jones et al. | 200/83 WM |
| 4,192,980 | 3/1980 | Kothe | 200/83 WM |
| 4,297,552 | 10/1981 | Lauritson et al. | 200/83 P |
| 4,456,801 | 6/1984 | Lauritson et al. | 200/83 P |
| 4,471,182 | 9/1984 | Wielgos et al. | 200/83 P |
| 4,490,708 | 12/1984 | Thompson | 337/319 |
| 4,755,786 | 7/1988 | Shanahan | 337/319 |
| 4,990,728 | 2/1991 | Joyce | 200/83 P |

*Primary Examiner*—Gerald P. Tolin
*Attorney, Agent, or Firm*—R. A. Johnston

[57] ABSTRACT

A pressure switch assembly has a preassembled spring capsule assembled onto a deck structure with a snap switch thereon to form a subassembly which is snap-locked into the cup-shaped housing. A rotary cam drum is provided in the housing with an external shaft for changing the setting. An adjustment lever has a bifurcated portion nested about the inner periphery of the cam drum and a threaded external adjustment is provided for moving the lever position against the spring capsule for calibration. The pressure switch is completely assembled from one side of the housing.

5 Claims, 4 Drawing Sheets

SUBASSEMBLY FOR A PRESSURE SWITCH

This application is a continuation of application Ser. No. 561,414, abandoned, filed Aug. 1, 1990, which is a division of Ser. No. 350,883, filed May 12, 1989, now U.S. Pat. No. 4,990,728.

BACKGROUND OF THE INVENTION

The present invention relates to pressure sensing devices of the type operable to effect making and breaking of electrical contacts in response to quite small changes of a predetermined magnitude in a fluid pressure signal. Devices of this type are employed in numerous applications for electrical control purposes and are commonly employed in clothes washing machines for sensing the water level or head of water in the washing receptacle or tub for controlling an electrically operated water filling valve.

In applications of the aforementioned type, namely, clothes washing machines, the pressure switch is required to sense a change in water level of only a few inches and, therefore a high degree of sensitivity is required. In applications of this type, it has been found convenient to provide the sensitivity by employing a relatively large diameter flexible diaphragm which exhibits sufficient movement in response to the small pressure changes, on the order of an inch of water, or less, to enable the necessary movement to provide actuation of a switch. It has been found desirable in clothes washer pressure switch applications to employ a toggle or snap-acting switch mechanism to prevent arcing and burning of the contacts when the flexible diaphragm moves to a position holding the switch near the trip point. The instability of a snap-acting switch near the trip point enables a very minute amount of switch actuator movement to cause the switch to go overcenter and toggle. The spring biased toggle throws the contacts a sufficient distance under a positive force to provide a very positive making and breaking with sufficient force to resist chattering of the contacts due to any surrounding vibration in the washing machine.

In designing and manufacturing pressure switches for household washing machines for high volume production, it has been desired to minimize the size of the pressure switch for convenience of installation on the washing machine control panel. However, in order to provide the desired movement or sensitivity to the small sensed pressure changes, it has been necessary to employ a sensing diaphragm having a diameter on the order of three inches (76 millimeters) which has resulted in an undesirable bulkiness or excessive overall volume for the pressure switch. Thus, the required size of the diaphragm has limited the ability of the designer to provide a compact pressure switch for washing machine applications. Heretofore washing machine pressure switches have been commonly provided with a mounting bracket for attachment to the structural housing or control panel of the washing machine; and it has been desired to eliminate this costly extra part in high volume production.

In addition, it has been desired to provide improved ways or means of assembling a pressure switch of the aforementioned type in high volume mass production in a manner that minimizes manufacturing costs and assembly difficulties. Existing appliance pressure switch designs have employed a metal cover or metal clamping band provided about the periphery of the pressure switch for clamping a pair of housing shells together with the peripheral bead of the diaphragm clamped therebetween by deforming the metal cover or band over the pressure switch housing. This assembly technique has proven to be undesirable because once assembled, if leakage about the diaphragm is detected during final testing and calibration, the pressure switch cannot then be disassembled without destruction of the cover or clamping band. This has resulted is costly scrappage or rework in high volume pressure switch production. Accordingly, it has thus been desired to provide a way or means of assembling a pressure switch of the above-described type in high volume production in a manner that provides ease of assembly, reliable sealing of the diaphragm and yet permits nondestructive disassembly of the pressure switch in the event leakage about the diaphragm is detected after assembly.

Furthermore, it has been desired to find a way or means of providing for final calibration of the pressure switch after the unit has been completely assembled.

SUMMARY OF THE INVENTION

The present invention addresses the above-described problems of providing a design for a compact, low cost reliable appliance pressure switch that is sensitive to small pressure changes and is easy to manufacture in high volume production. The pressure switch of the present invention employs a snap acting switch for making and breaking a set of electrical contacts in response to movement of a pressure sensing flexible diaphragm. The snap acting switch of the present invention employs a unique configuration wherein the toggle mechanism has a mechanical force disadvantage with respect to the resultant of the integrated pressure forces applied to the switch from the pressure responsive diaphragm. The arrangement of the switch of the present invention thus enables a diaphragm having a substantially smaller diameter than heretofore employed to provide the requisite force for effecting actuation of the switch, thereby enabling the overall volume of the pressure switch to be substantially reduced. The diaphragm employed for the pressure switch of the present invention is of the order of 85% of the diaphragm diameter of prior pressure switches designed for similar washing machine applications.

The smaller diaphragm of the pressure switch of the present invention is permitted to move through a greater distance with a sufficient force to effect actuation of the snap acting switch, yet provides for accurate and repeatable actuation of the switch.

The housing of the pressure switch of the present invention employs a unique assembly technique wherein the snap acting switch and its preload spring capsule are preassembled on a support deck as a subassembly for assembly as a unit into the switch housing.

The flexible pressure sensing diaphragm has a peripheral bead which is sealed between the switch housing and a cover which is snap-locked onto the housing for sealing the diaphragm.

A sensing chamber is formed between the cover and the diaphragm; and, the diaphragm is simultaneously engaged at assembly with a force transfer means connected to the switch actuator. The entire housing assembly of the pressure switch of the present invention is snapped together and capable of being disassembled without destruction of any portions thereof. The assembly does not require a deformed metal cover or band to provide the sealing of the pressure sensing diaphragm.

A bifurcated lever is nested about the inner periphery of a rotary adjustment cam drum and about the spring capsule. The lever is fulcrummed for pivotal movement on the housing to permit calibration of spring capsule preload force on the switch actuator. The calibration lever is fulcrummed on the undersurface of a screw head which has its shank extending externally of the pressure switch for calibration after final assembly.

An annular cam having a shaft extending externally of the switch housing is rotatable for user selection of the desired spring capsule preload for changing the setting of the pressure switch.

The housing has an attachment portion extending therefrom about the cam shaft; and, radially extending lugs are provided thereon for enabling bayonet twist lock installation onto an appliance control panel without the need for a separate mounting bracket.

The present invention thus provides a unique and novel compact low cost appliance pressure switch which may be calibrated externally after assembly and mounted directly by insertion into the control panel of the appliance.

DETAILED DESCRIPTION

Figure 2:
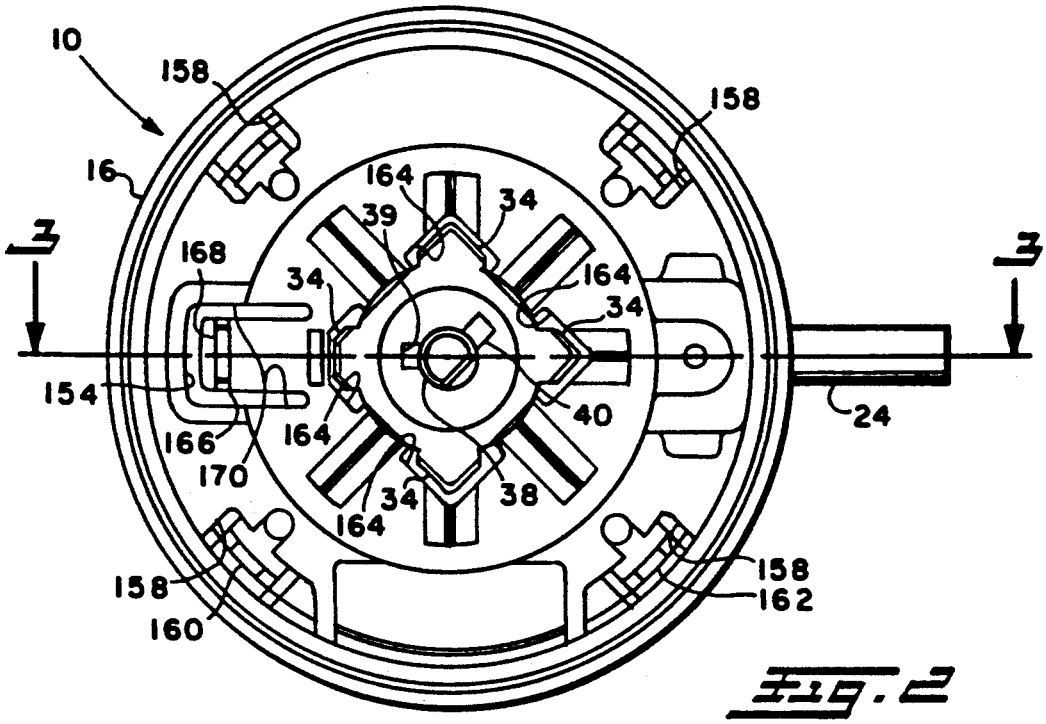
FIG. 2 is a top view of the pressure switch of FIG. 1.
Figure 1:
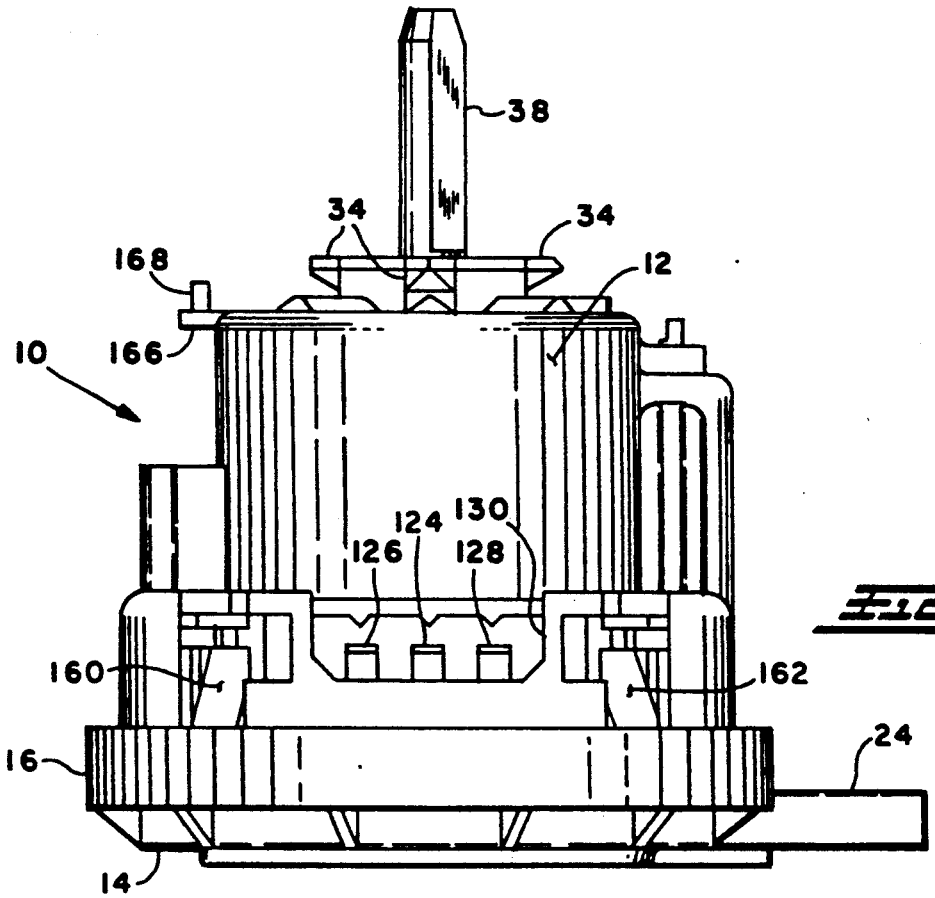
FIG. 1 is a side view of the assembled pressure switch of the present invention.
Figure 3:
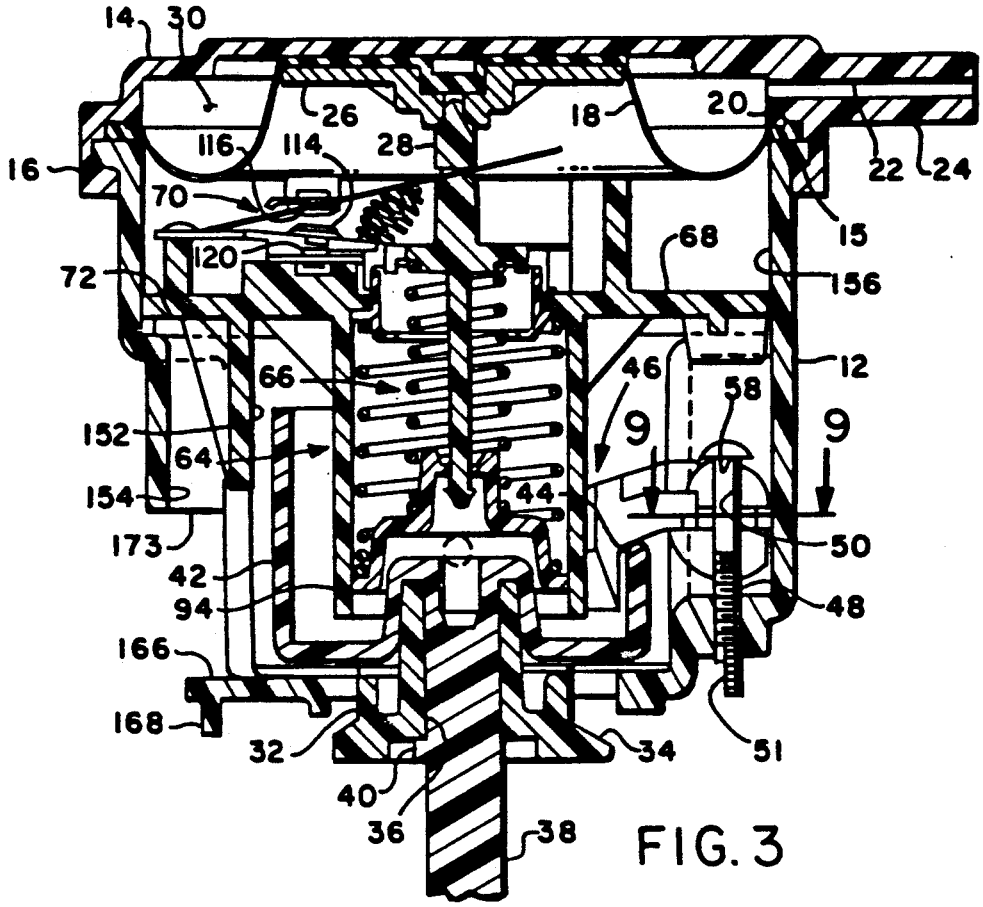
FIG. 3 is a section view somewhat enlarged taken along section-indicating lines 3—3 of FIG. 2.

Referring to FIGS. 1 through 3, the assembled switch is indicated generally at 10 and has a cup-shaped housing shell 12 secured to a housing cover 14 which has an annular flange 16 snap-locked over a flange 15 provided on the periphery of the housing shell 12. A flexible diaphragm 18 is provided having a relatively large convolution formed about the periphery thereof and the diaphragm 18 has a peripheral bead 20 which is received between the housing shell 12 and cover 14 and sealed therebetween. The cover 14 has an inlet port 22 provided in an external nipple 24 adapted for connection to a fluid pressure signal.

Diaphragm 18 has a rigid support plate 26 provided in the central region thereof to give rigidity to the diaphragm for the transmission of integrated pressure forces to a mechanical operating rod 28 which will hereinafter be described in greater detail.

The diaphragm 18 defines in association with the cover 14 a fluid pressure sensing chamber 30 which communicates with the inlet port 22.

The housing shell 12 has provided, on the closed end thereof and preferably formed integrally therewith, an attachment portion 32 which has a plurality, preferably four, radially outwardly extending lugs or flanges 34 disposed in equally spaced arrangement circumferentially thereabout. The flanges 34 are adapted for insertion and rotary locking into an aperture provided in an appliance control panel.

The attachment portion 32 has a central bore 36 provided therethrough through which is journaled a shaft 38 which is inserted in bore 36 from the interior of the shell 12. The bore 36 may optionally have a groove 39 provided therein (see FIG. 2) such that a locking tab 40 (see FIG. 3) may be provided on the shaft and rotated out of alignment with the groove upon insertion of a shaft for retention in the housing 12 in a manner well known in the art. Shaft 38 is adapted for having a knob (not shown) attached to the free end thereof after assembly of the housing onto an appliance control panel for permitting user rotation of the shaft 38 with respect to the housing.

Shaft 38 has attached thereto, preferably integrally, an annular generally cup-shaped cam drum 42 which has a cam surface 44 formed on the rim thereof about a portion of the circumference.

Figure 9:
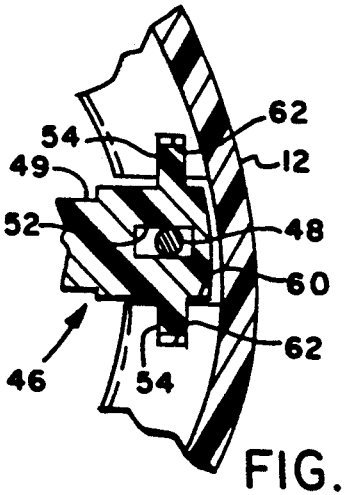
FIG. 9 is a partial section view taken along section indicating line 9—9 of FIG. 3.
Figure 7:
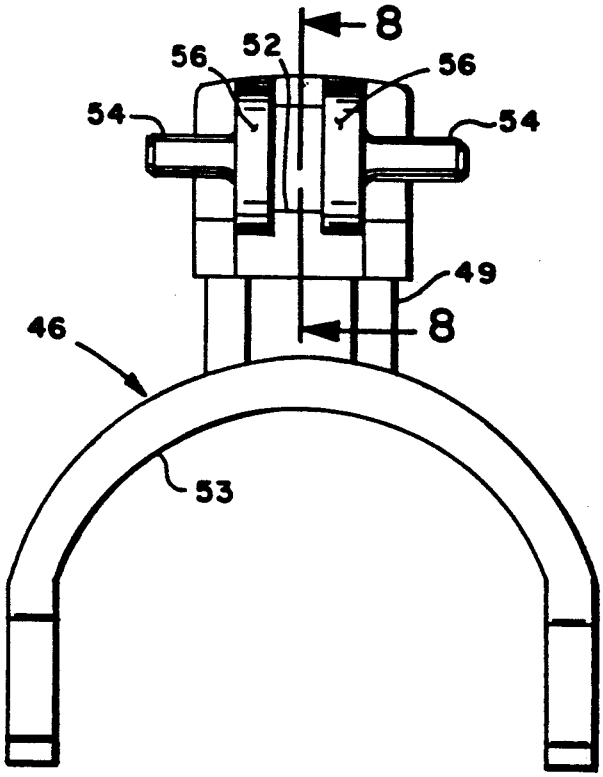
FIG. 7 is a plan view of the calibration lever.

Referring to FIGS. 3, 7 and 9, a calibration lever indicated generally at 46 is pivotally mounted on the housing 12 by a threaded fastener 48 which has the threaded shank thereof extending through a threaded bore 50 provided in the closed end of the housing. The threaded portion of the fastener 48 extends outwardly of the housing 12 and has a flattened surface 51 provided thereon to enable the fastener to be gripped by a suitable tool for rotation from the exterior of the housing.

Figure 8:
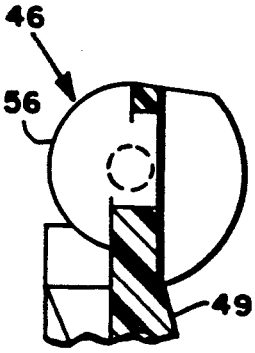
FIG. 8 is a section view taken along section-indicating line 8—8 in FIG. 7.

Referring to FIGS. 7, 8 and 9, the lever mechanism comprises a shank portion 49 which is integrally attached to a bifurcated portion 53 having a generally C-shaped configuration which is sized to nest in closely spaced relationship with the inner periphery of the cam drum. The Shank Portion has a generally rectangular slot 52 formed therein and which has a threaded fastener 48 received therethrough. The shank also has a pair of locating lugs 54 provided thereon which extend outwardly in opposite directions in aligned relationship.

Referring to FIGS. 7 and 8, the shank 49 has a pair of spaced parallel semi-circular fulcrumming surfaces 56 disposed on opposite sides of the slot 52. The fulcrumming surfaces are registered against the underside 58 of the head of the fastener 48 for sliding pivotal contact therewith. Upon rotation of the cam drum 42, movement of the lever mechanism 46 is caused by the cam surface 44, which is in continuous registration therewith as will hereinafter be described in greater detail.

Referring to FIG. 9, the shank portion 49 of the lever mechanism 46 is illustrated as installed in the housing 12 in a vertical groove or cut out 60 which has in each of the opposite sides thereof a groove 62 into which is received in vertical sliding engagement one of the lugs 54 extending from the shank 48 of the lever mechanism 46. It will be understood that when the threaded fastener 48 is rotated in the housing, the undersurface 58 of the head thereof bearing against the fulcrum surfaces 56 causes the shank 49 of the lever to move upwardly or downwardly in FIG. 3; and, such movement is guided by sliding of the lugs 54 in the groove 62.

Referring to FIG. 3, a switch support subassembly indicated generally at 64 is shown installed in the switch housing with the end of the operating rod 28 registered in a guide bore provided in the diaphragm plate 26. The subassembly 64 comprises a spring capsule indicated generally at 66, a deck plate 68 and a snap switch mechanism indicated generally at 70. The deck 68 is registered against a circular shoulder 72 provided in the housing 12.

Figure 10A:
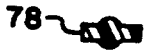
FIG. 10*a* is a section view taken along section-indicating line 10*a*—10*a* of FIG. 10.
Figure 10:
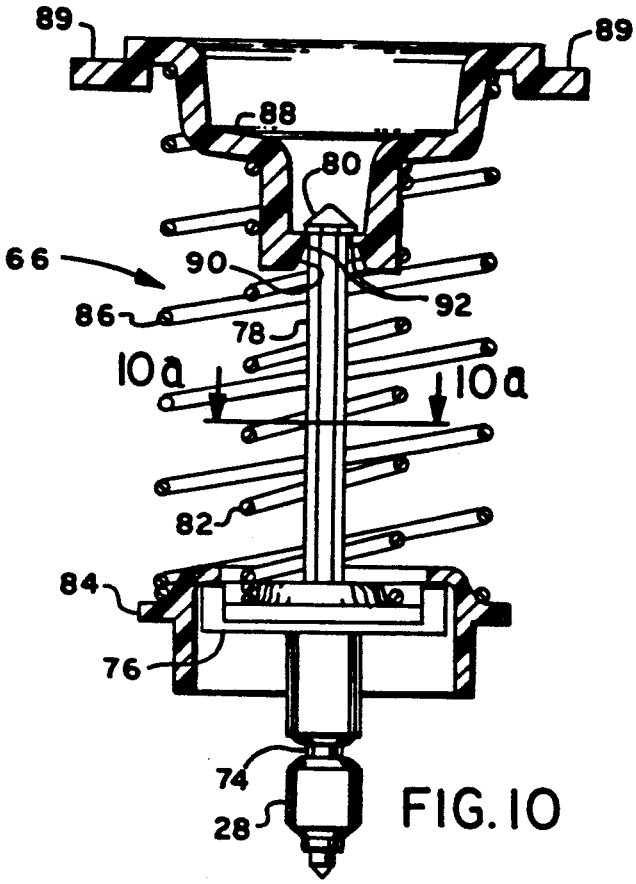
FIG. 10 is a section view of the preload spring capsule.

Referring to FIGS. 4, 5, 6 and 10, the construction of the switch support subassembly 64 will be described in greater detail. With reference to FIG. 10, the spring capsule 66 is shown in enlarged detail. The operating rod 28 has a switch actuator engaging groove 74 provided adjacent the free end thereof and has a circular flange 76 provided thereon. The rod extends upwardly therefrom in an elongated generally rectangular sectional portion 78 having a ribbed configuration as shown in FIG. 10*a*. The upper end of the rod portion 78 has an enlarged flanged configuration having a barbed axial end as denoted by reference numeral 80 in FIG. 10.

A first compression spring 82 is received over the upper portion 78 of the operating rod 28 with the lower end thereof registered against the upper surface of the operating rod flange 76. An annular spring retaining flange 84 is received over the spring 82 and registers against the outer periphery of the rod flange 76. The annular flange 84 has registered thereagainst the lower end of a second larger diameter compression spring 86 received over the first spring 82. A spring retaining cup 88 has a central aperture 90 provided in the bottom thereof which aperture has a pair of oppositely disposed inwardly extending lugs 92 which are snapped over the flanged end 80 of the operating rod for retaining the cup thereon. With the cup retained on the upper portion 78 of the operating rod, the upper end of springs 82 and 86 are registered against shoulder portions of the cup 88 and are maintained in a desired slight amount of compression by the cup 88. The cup is free to slide vertically on the portion 78 of the operating rod upon application of sufficient force thereon to overcome the bias of the springs 86, 82. A pair of diametrically opposite guide lugs 89 extend outwardly from the sides of the cup retainer 88 to a diameter greater than the diameter of the spring 86.

Figure 6:
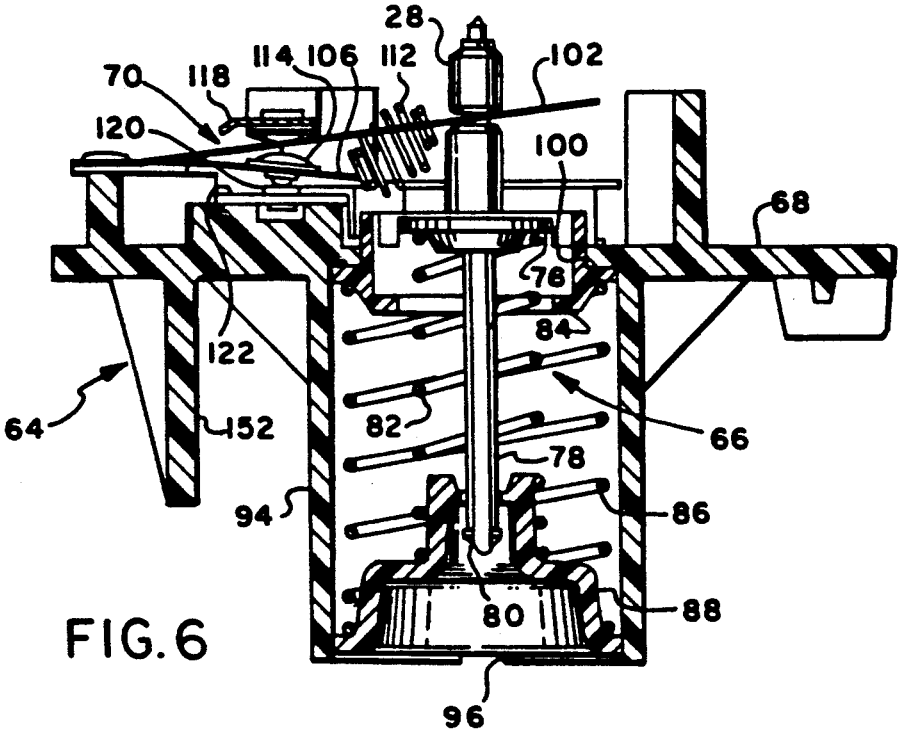
FIG. 6 is a section view taken along section-indicating line 6—6 of FIG. 5.
Figure 11:
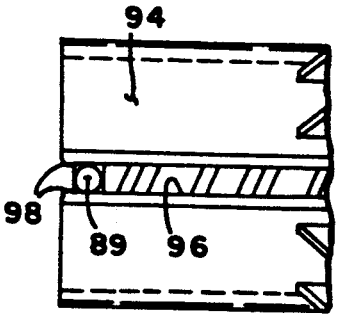
FIG. 11 is a view taken along section-indicating line 11—11 of FIG. 4.

Referring to FIGS. 4, 5, 6 and 11, the spring capsule 66 is shown installed in a cylindrical housing portion 94 extending downwardly from deck 68 which portion 94 has a pair of diametrically oppositely disposed vertical slots 96 formed therein, the lower end of one of which is shown in FIG. 6 and a portion of one of the slots is illustrated in FIG. 11. The lugs 89 of the spring retainer 88 are received in and guided in the slots 96 and retained therein by detents denoted by the reference numeral 98 in FIG. 11.

With reference to FIG. 6, the annular spring retainer 84 is received in an aperture 100 formed through the deck 68 in the center region of the cylindrical portion 94. The outer periphery of the retainer 84 registers against the surface of the deck 68 about the periphery of aperture 100; and, spring 86 is maintained in compression between the cup 88 and the annular retainer 84.

The spring 82 biases the operating rod flange 76 in an upward direction in FIG. 6.

Figure 5:
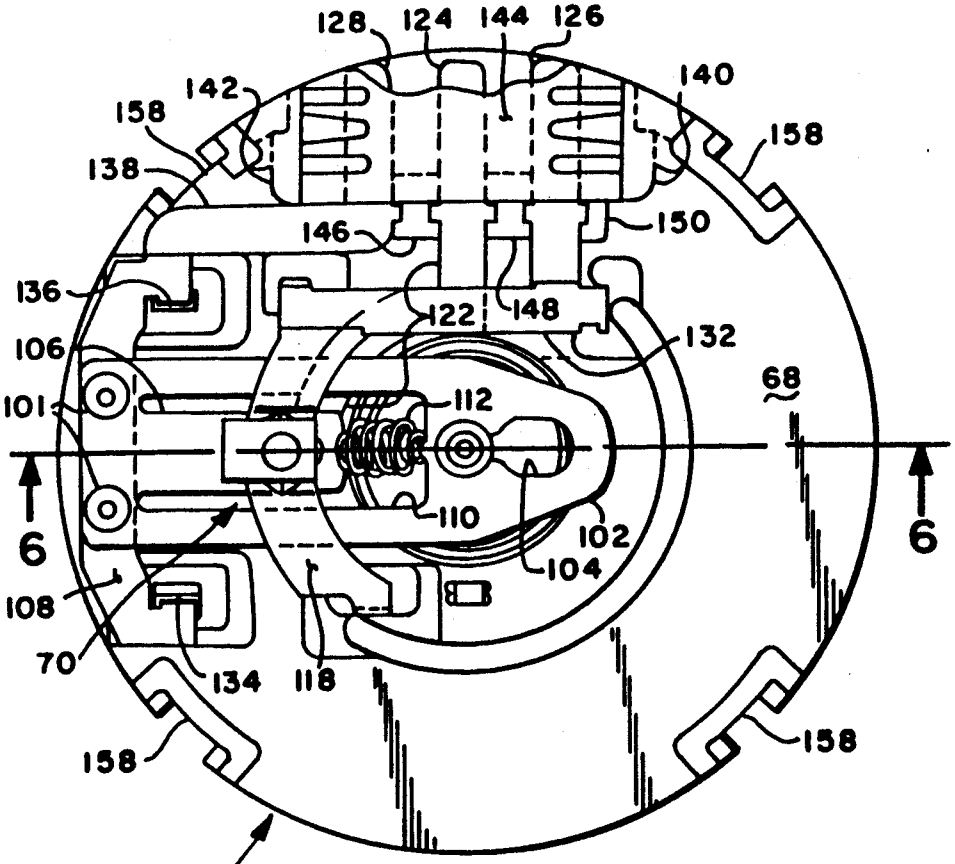
FIG. 5 is a side view of the support subassembly of FIG. 4.
Figure 4:
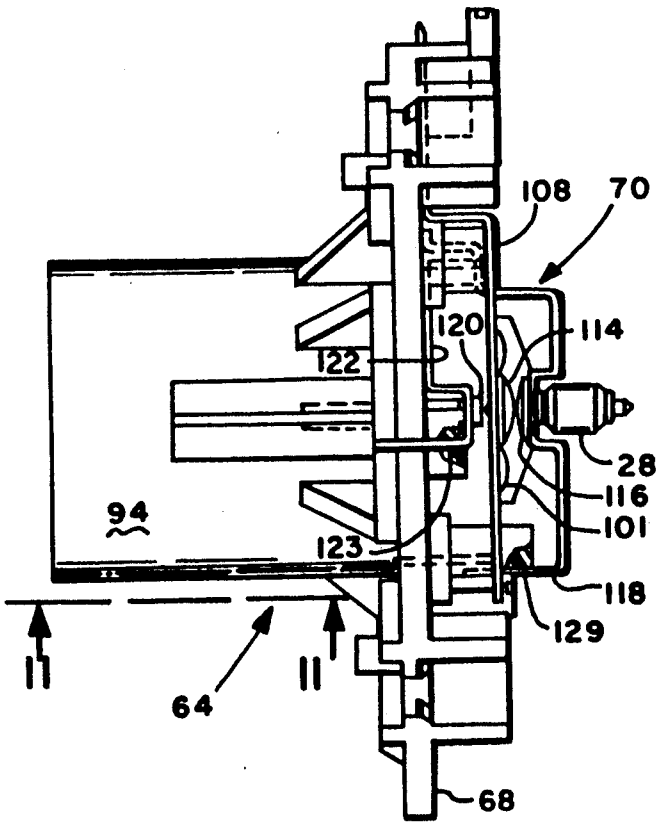
FIG. 4 is a side view of the switch support deck subassembly with the spring capsule switch installed.

Referring to FIGS. 4, 5 and 6, the snap acting switch 70 comprises a cantilevered actuator blade 102 which has a slot 104 therein adjacent the free end thereof which slot is received in the groove 74 in operating rod 28. A contact blade member 106 is formed integrally as for example by stamping, with the actuator blade 102. Blades 102, 106 are commonly cantilevered from a mounting on the deck 68 and secured by riveting to a bus bar 108.

The actuator blade 102 has a cut out portion 110 provided therein with blade 102 nested therein. The blades 102, 106 are subjected to reaction forces of a compression spring 112 interposed therebetween.

Blade 106 has a movable electrical contact 114 mounted adjacent the free end thereof. Contact 114 is riveted through blade 106 so as to provide electrical contact surfaces on both opposite sides of blade 106. A stationary side contact 116 is aligned therewith and mounted on a second bus bar 118 which straddles the blade actuator 102. A third electrical side contact 120 is disposed on the opposite side of the contact 114 from the contact 116; and, the third contact 120 is supported by a third bus bar 122 which is attached to the deck 68.

The arrangement of the switch blades and contact members is such that the snap action switch mechanism 70 has a single pole double throw function. The contact blade 106 causes the contact 114 to transfer rapidly between the side contacts 120 and 116 upon toggling under the action of spring 112. It will be understood that the point of application of actuating force from the diaphragm on the end of operating rod 28 to the blade 102 is at a greater distance from the fulcrum thereof, which is in the region of the attachment to the bus bar 108 near the rivets 101, than the distance of the contacts 114, 116, 120 from the fulcrum of the blade 106 which is also in the region of the rivets 101. Thus, in the illustrated arrangement of the switch mechanism 70, the movement of the end of the spring 112, as it reacts against the cutout 110 in blade 102, has a mechanical force advantage over the end of the spring reacting against the end of blade 106. Thus, a lesser force is required to actuate the switch than if the contacts were attached to the end of blade 102 and the actuation force applied to blade 106. Therefore, the preferred illustrated arrangement of the switch mechanism 70 requires that the actuator rod 28 undergo a greater amount of movement in order to effect toggling or snap acting of the spring 112 for transfer of the blade 106. The increased travel requirement is accomplished however with a lower required force and thus, for any given pressure sensitivity, a smaller diaphragm is required.

The bus bar 122 for the contact 120 has one end thereof anchored in a slot 123 provided in deck 68 as shown in the broken-away portion of the deck 68 in FIG. 4. The bus bar 122 is curved as shown in FIG. 5, through approximately a 90 degree central arc of the deck plate, to provide integrally therewith a contact terminal 124 which extends radially to the outer periphery of the deck 68 forming the center one of three terminals 124, 126, 128 which extend in spaced parallel relationship and are adapted for external connection thereto. Referring to FIG. 1, the cut out 130 is provided in the housing 12 to permit access to the three contact terminals 124, 126, 128.

Referring to FIGS. 4 and 5 the bus bar 118 for contact 116 has one end thereof anchored by an end tab received in a slot 129 provided in deck 68 as shown in the broken-away portion in FIG. 4. Bus bar 118 has a curved portion which straddles the blade 102 and an offset for connection to a straight section 132 which connects to the terminal 126.

The bus bar 108 is anchored into the deck 68 by tabs provided thereon received in mounting slots denoted by the reference numerals 134, 136 in FIG. 5 and is offset to provide a straight portion 138 which connects to the terminal 128.

The terminal strips 128, 124, 126 are covered by a shroud 140 which is snap-locked onto the deck between stanchions 142, 144. Shroud 140 has lugs on the under surface thereof to maintain the terminal strips 124, 128, 126 against the deck plate between three guide lugs 146, 148, 150 provided integrally on the deck plate 68.

The support subassembly 64, including the spring capsule 66 and snap acting switch 70, is assembled into the housing 12 as a unit by sliding the subassembly into the housing from the open end thereof prior to installation of cover 14. The subassembly 64 is aligned in the housing by a guide lug 152 provided on the deck 68 which guide lug is received in a slot or groove 154 provided in the housing as shown in FIGS. 2 and 3. The outer diameter of the deck 68 is closely interfitted with the inner surface 156 of the wall of housing 12 and is retained therein by suitable locking tabs 162 formed in the wall of the housing in the cut outs denoted by the reference numeral 158 in FIG. 5. With reference to FIG. 1, two of the locking tabs provided in the cut outs 158 in the housing shell are denoted by the reference numerals 160, 162.

As mentioned above, the deck plate 68 is registered against the annular shoulder 72 provided in the housing 12 as illustrated in FIG. 3.

After installation of the support assembly 64 into the housing 12, the diaphragm Plate 26 is engaged with the end of operating lug 28 and the diaphragm received thereover with the Peripheral bead 20 of the diaphragm registered in a groove provided about the periphery of the housing flange 15. The cover 14 is then snapped thereover and secured thereon to seal the bead 20 of the diaphragm for providing the pressure sensing chamber 30.

Referring to FIGS. 1 and 2, the radially inwardly extending tabs 162 are formed by providing the cutouts 158 in the housing shell in such a manner that the cutouts extend radially inwardly a sufficient amount to enable a molding insert to be provided in the axial direction for forming tabs 162.

Similarly, mounting lugs 34 are formed by providing cutouts 164 in the end of housing shell 12, which cutouts 164 extend radially outwardly beyond the lugs 34 to enable the lugs 34 to be formed by providing a mold insert in the axial direction in the cutouts 164. The provision that the cutouts 158 and 164 to extend radially beyond the tabs formed therein thus permits axial inserts to be made for molding of the housing shell 12. The mold halves thus do not require radial inserts; and, the molding may be performed by pulling the molds in only the axial direction.

Referring to FIGS. 1, 2 and 3, a locating tab 166 is integrally formed with housing shell 12 and extends radially outwardly therefrom with respect to the shaft 38 and in line with the closed end of the cup-shaped housing. An engagement lug 168 is formed on tab 166 near the end thereof and at generally right angles thereto extending in the direction of shaft 38.

With reference to FIG. 2, a slot having sides 170 is formed in the shell on either side of tab 166. The side of the shell is cut out below the tab to external slot sides 170 to the surface denoted 172 in FIG. 3. The slot bounded by sides 170 and ending with surface 173 serves to permit molding of housing shell 12 of plastic material with inserts for forming the radially extending lug 168, with only axial pulling of the mold prices. Tab 166 and lug 168 function to orient and locate the rotational position of the pressure switch on an appliance control panel upon insertion therein and twist-locking of lugs 34. The tab 166 is resiliently deflectable, to permit rotation of the housing 12 upon insertion of attachment portion 32 and lugs 34 into a control panel, to a position where lug 168 snaps into a locating aperture provided in the control panel.

The present invention thus provides a unique and novel low head sensing pressure switch for water level sensing in appliances which is compact in size and simple in construction enabling assembly from one direction in a housing, with provisions for external calibration after assembly. The present invention utilizes a snap acting switch mounted on a subassembly including a spring capsule which may be assembled into the housing as a unit. The mechanical advantage of the actuator blade of the switch of the present invention permits a reduced sized diaphragm to be employed yet maintains the desired sensitivity to small changes in pressure. The present invention provides a unique snap locking assembly which eliminates the need for deforming a metal cover or clamping band to maintain the switch assembled and the pressure responsive diaphragm sealed about its periphery. The present invention provides for molding of a plastic housing with radial locking tabs with a unique construction which permits the molding to be accomplished by molds requiring pulling only in the axial direction.

Although the present invention as hereinabove been described with respect to the illustrated embodiments, it will be understood that the invention is capable of modification and variation and is limited only by the following claims.

I claim:

1. In a pressure switch of the type having a first cupped housing shell (12) with a fluid pressure sensing chamber (30) and a pressure responsive diaphragm (18) disposed therein and movable in response to changes in chamber pressure for actuating a switch, a sub-assembly removable from said first shell comprising:

(a) a support deck structure (68) having an aperture therethrough (100) and having a snap-acting switch (70) mounted on one side thereof, said switch having an actuator member (102) extending over said aperture; and, (b) a spring capsule (66) removably assembled to said support deck structure including a preload spring (82) and a spring retaining cup member (88) registered against one end of said spring with the opposite end of said spring registered against a first portion (76) of an operating rod (28), said rod including other portions (78) thereof operative to limit movement of said rod in one direction with respect to said retaining cup member, said capsule being disposed on said deck on the side opposite said switch with said rod extending through said aperture and in registration with said switch actuator member, wherein said spring retaining cup member (88) is guided for sliding movement on said deck structure and retained thereon to preload said spring, said support deck with said spring capsule mounted thereon comprising a unit adapted for sliding assembly in said pressure switch first housing shell.

2. The subassembly defined in claim 1, wherein said support deck has a generally circular configuration and includes a generally cylindrical portion extending therefrom with said spring capsule nested therein.

3. The sub-assembly defined in claim 1, wherein said spring capsule includes a second spring (86) surrounding said preload spring, said second spring having one end registered against said spring retaining cup member (88) and the other end registered against an annular retaining flange (84) with said preload spring (82) and said rod portions (76) passing through said flange, wherein said rod has said other portions (78) thereof in a lost motion connection to said spring retaining cup member.

4. The sub-assembly defined in claim 1, wherein:

(a) said spring capsule includes a second coiled spring (86) surrounding said preload spring, with one end of said second spring registered against said spring retaining cup member (88) and the other end registered against an annular retaining flange (84) having said rod member (28) passing therethrough; and, (b) said annular retaining flange (84) registers against said portions (76) of said rod in the unassembled state to retain said capsule as a unit.

5. A pressure switch assembly comprising:

(a) a cup-shaped housing shell (12);

(b) a support deck sub-assembly (64) slidably received in said shell including a snap-acting switch (70) secured thereto and a removable preload spring capsule (66); and, (c) said housing shell having a plurality of spring tabs (162) formed integrally thereon for retaining said deck sub-assembly therein, said tabs resiliently deflectable in a radial direction, said shell having cut-outs (158) in the closed end of said cup shape, wherein said tabs are formed by pulling of forming molds for said tabs in an axial direction through said cut-outs.

* * * * *